United States Patent [19]

Chabria

[11] 4,419,718

[45] Dec. 6, 1983

[54] POCKET FLASHLIGHT

[75] Inventor: Paul R. Chabria, West Chicago, Ill.

[73] Assignee: Press-A-Lite Corporation, West Chicago, Ill.

[21] Appl. No.: 273,229

[22] Filed: Jun. 12, 1981

[51] Int. Cl.[3] ..... F21L 15/00

[52] U.S. Cl. ..... 362/205; 362/189; 200/60

[58] Field of Search ..... 362/205, 189; 200/60

[56] References Cited

U.S. PATENT DOCUMENTS

| | | | |
|---|---|---|---|
| 3,796,869 | 3/1974 | Stone | 362/189 |
| 4,032,773 | 6/1977 | Halliday et al. | 362/189 |
| 4,122,510 | 10/1978 | Halliday | 362/189 |
| 4,242,724 | 12/1980 | Stone | 362/205 |

*Primary Examiner*—Irwin Gluck
*Attorney, Agent, or Firm*—Howard H. Darbo

[57] ABSTRACT

The simple switch of a small pocket flashlight consists of a single spring wire conductor extending from the center post positive terminal diagonally downwardly across the insulating body separating the two cells toward the uncovered metal can negative terminal of the other cell. When pressure is applied through the flexible nonconductive flashlight jacket, the wire conductor is brought into contact with the metal can negative terminal of the other cell to close the series circuit through the cells and lamp. In opening and closing the switch, bending of the wire conductor is limited to the portion remote from the positive terminal contact end by a fulcrum formed by a bend in the wire and engaging the insulating body between the two cells.

1 Claim, 5 Drawing Figures

POCKET FLASHLIGHT

BACKGROUND AND SUMMARY OF THE INVENTION

Many thousands of the simple pocket flashlight to which this improvement invention relates have been made and sold. As shown in Stone Pat. No. 3,796,869, the flashlight is designed to be used until the dry cells forming the battery are exhausted and the entire flashlight is then thrown away. As shown in Halliday U.S. Pat. No. 4,032,773, the individual cells may be removed and replaced by fresh cells and continued use of the flashlight.

As exemplified by the simple pocket flashlights described in these two patents, the unit consists of a pair of small dry cells spaced apart and supported by a body of insulating material. The flashlight lamp is permanently connected in series between the positive terminal of the first cell with the negative terminal of the second cell, the negative terminals of both cells being the exposed metal cans of the two cells. The very simple switch consists of a spring wire connected at one end to the positive terminal of the second cell and extending diagonally downwardly toward the metal can negative terminal of the first cell. This structure is covered by a flexible jacket through which the switch wire may be pressed inwardly until the end of the wire remote from its connection with the positive terminal of the second cell makes electrical contact with the negative terminal of the first cell to thereby complete the series lamp circuit. When the pressure is released, the switch wire springs back to its normal position out of contact with the first cell negative terminal whereupon the light is turned off.

It has been observed that in use a significant number of these flashlights exhaust their batteries as a consequence of the unintended lighting and burning of the flashlight due to inadequate spring force to hold the switch wire out of closing contact against even slight pressure that may be exerted while the flashlight is resting in a pocket or otherwise at repose in contact with other objects.

When the cells of the flashlight battery are exhausted due to either the intended or unintended closing of the operating circuit, the batteries must be discarded promptly to avoid damage from the highly corrosive liquid that may escape after a short time from the exhausted cells. The face of exhaustion of the battery is noticeable to the user when the light is intentionally turned on but when the circuit is closed while the flashlight is resting somewhere and the light is not noticed, damage from the corrosive liquid is a real danger.

The object of this invention is to improve the dependability of spring-operating switch by increasing the strain imposed in the switch wire when closing the switch so that a greater force will ensure that contact is broken and the circuit will remain open when the manually applied pressure has been released to turn out the light even in the event of the application of unintended small pressures to the area of the jacket overlying the switch wire. To accomplish this objective, the wire is formed to provide a fulcrum bearing against the surface of the insulator body between the two cells serving to essentially limit the bending of the wire to the portion between the fulcrum and the switching contact remote end of the switch wire. Thus, instead of distributing the bending throughout the length of the wire from the point of attachment to the positive terminal of a cell to the remote end contact, involving a gentle and weak stressing of the wire, the same distance of movement of the contacting end of the switch wire to engagement with the negative terminal of the other cell is limited to the end portion, only, of the wire imposing greater stress and greater loading of spring tension to dependably effect disconnection when light is not desired.

DESCRIPTION OF THE DRAWING

In the attached drawing,

FIG. 5 is a detail view of the conductor wire switch embodying the improvement invention.

DESCRIPTION OF EXAMPLE EMBODYING BEST MODE OF THE INVENTION

Figure 1:
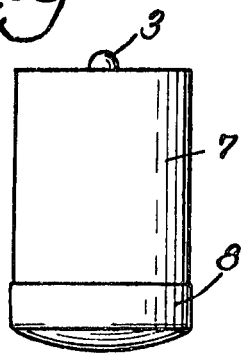
FIG. 1 is a side elevational view of the pocket flashlight embodying the invention.
Figure 2:
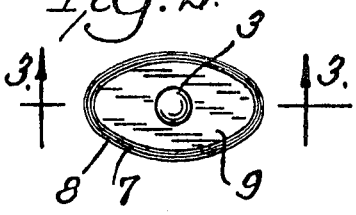
FIG. 2 is a top view of the flashlight.
Figure 3:
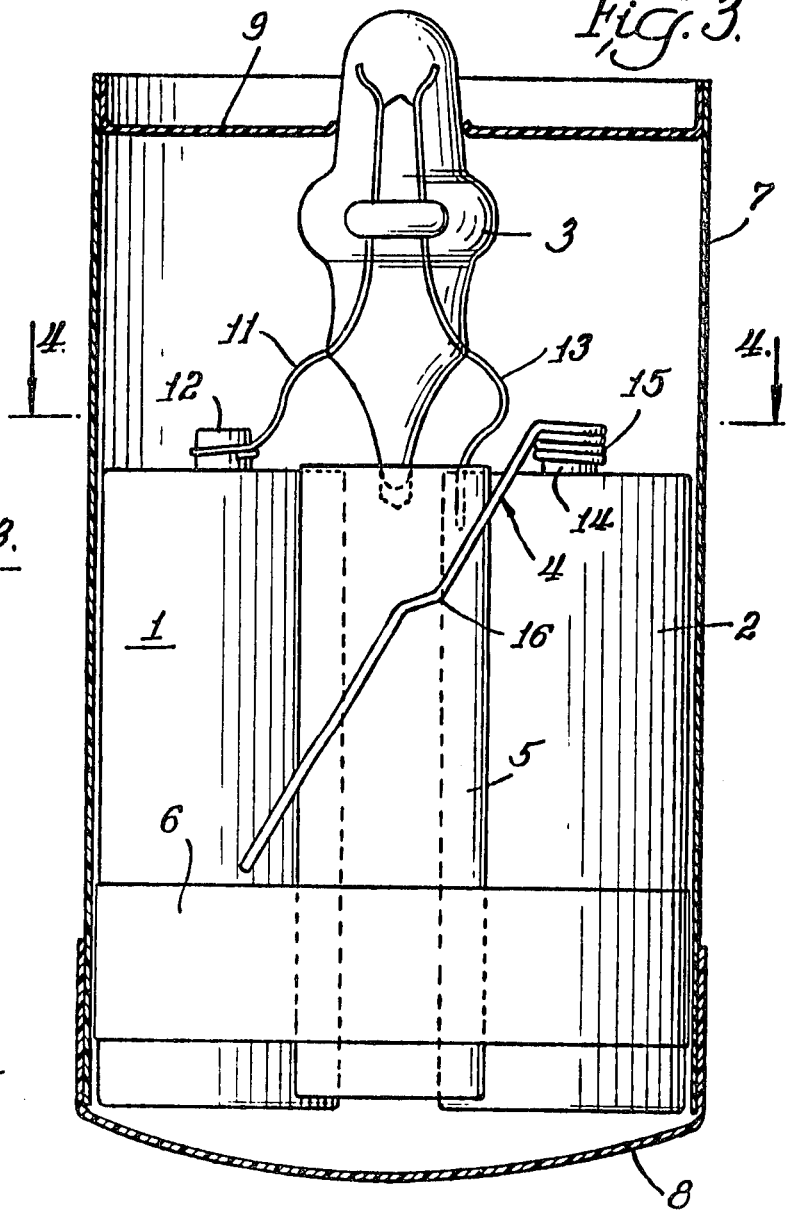
Figure 4:
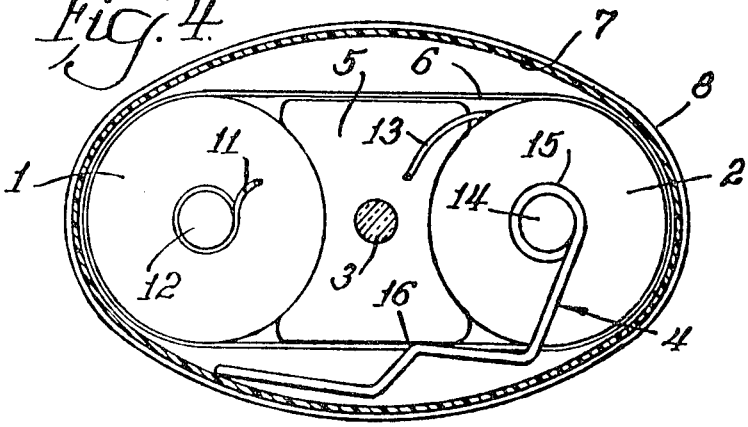
FIG. 4 is a cross-sectional view taken at the line 4—4 of FIG. 3.

The pocket flashlight illustrated in the drawing is designed to be discarded when the battery is exhausted. It comprises a pair of small zinc-carbon dry cells 1 and 2 connected in series with flashlight lamp 3 and a spring switch wire conductor 4. The cells are uncovered; that is, the zinc cans which form the negative terminals of the cells are exposed. As is shown in FIGS. 3 and 4, the two cells are arranged in upright position, held apart and supported by a spacer 5 of insulating material. As shown, the opposite sides of the spacer are cylindrically concave to receive the cylindrical cells which are bound to the spacer by means of a band 6 which may be pressure sensitive tape.

The battery and lamp assembly is enclosed within a jacket 7 of thin, flexible plastic or other material, the bottom of the jacket wall being closed by a cap 8. The top is closed by a wall 9 having a central opening 10 through which the top portion of the flashlight lamp protrudes.

Figure 5:
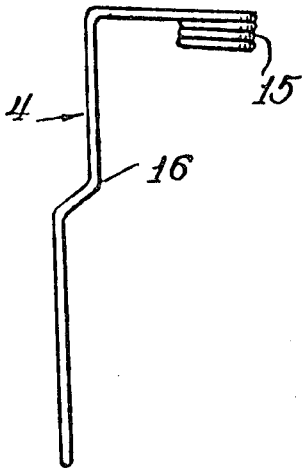
FIG. 5 is a cross-sectional view taken at the line 3—3 of FIG. 2.

The two cells of the battery are connected in series with each other and with the lamp. Lamp lead wire 11 is permanently connected to center post positive terminal 12 of cell 1 and the other lamp lead wire 13 is permanently connected to the zinc can negative terminal of cell 2. This leaves the connection between center post positive terminal 14 of cell 2 to be connected with the zinc can negative terminal of cell 1 to complete the flashlight circuit. This connection comprises the switching means for the flashlight. For this purpose, a spring copper wire switch conductor 4 is used. The spring wire switch is formed as shown separately in FIG. 5. A few circular turns are formed at one end with an internal diameter slightly less than the outside diameter of positive terminal post 14 so that electrical contact and support may be provided by forcing the coil spring-like terminus 15 upon positive terminal post 14. The conductor wire extends horizontally from this attachment terminus a sufficient distance to clear the negative terminal can of cell 2 and is then bent at a right angle and directed downwardly diagonally, as shown in FIG. 3, toward the exposed can negative terminal of cell 1 above band 6. When the spring wire has extended diagonally from the right angle bend a distance sufficient to engage with the surface of insulating spacer 5, the wire is bent outwardly away from the spacer to form a fulcrum 16 after which another bend redirects the wire switch conductor toward the negative terminal of can 1. Alternatively, a full "V" bend may be formed in the wire to provide the fulcrum at the apex of the "V". The configuration of the spring wire conductor 4 is such that fulcrum 16 is normally in contact with spacer 5, or nearly so, and the free end of wire conductor 4 is spaced away from the zinc can negative terminal of cell 1, maintaining the flashlight circuit in normally open condition.

When it is desired to turn on the flashlight, the circuit is closed by pressing the side portion of jacket 7 which overlies the free end portion of spring wire conductor 4 until the end makes contact with the zinc can negative terminal of cell 1 as described in Stone U.S. Pat. No. 3,796,869. However, (ignoring the very slight and incidental bending of the portion of wire 4 between terminus 15 and fulcrum 16) the bending of the spring wire, and therefore the loading of the wire spring, is essentially limited to the free end portion of the spring wire conductor beyond fulcrum 16 instead of being distributed throughout the entire length of the switch wire from the point of contact with the center post positive terminal of cell 2 to the free end of the conductor. When the switch-closing pressure is relieved, the wire conductor springs back to normal, open circuit position with greater alacrity than is experienced with the relatively "floppy" switch wire of the prior art flashlights of this type. Because the length of spring wire that must be bent to provide electrical contact and close the circuit is greatly less—approximately one-half—of that in known flashlights of this type, a greater force is necessary to make the contact thus minimizing the danger of unintended closing of the circuit by the ordinary small pressures that may be brought to bear when the flashlight is resting alongside another object.

ACHIEVEMENT

By the very simple expedient of providing a fulcrum at approximately the midpoint of the overall length of the spring wire switch conductor, the invention provides greater certainty in the switching operation and minimizes the likelihood of unintended closing of the flashlight circuit and thus the consequence of rendering the flashlight inoperative when needed and possibly exhausting the cells and causing damage to articles that may be exposed to the corrosive liquid which frequently escapes from exhausted dry cells. It must be understood that a flat spring conductor may be used, if desired, instead of the wire switch conductor.

I claim:

1. In a flashlight comprising first and second dry cells spaced apart in upright position and supported by a body of insulating material, each said cell having a center post positive terminal at the top thereof and an exposed metal can negative terminal, a lamp connected in series between said positive terminal of said first cell and said negative terminal of said second cell, switching means comprising a spring wire conductor connected at one terminus thereof to said positive terminal of said second cell and extending diagonally downwardly over said insulating body toward said first cell, the free end of said spring wire conductor being normally spaced from said exposed metal can negative terminal, and a flexible jacket covering said cells and switching means through which said spring wire conductor may be pressed inwardly to bring said free end of said spring wire conductor into electrical engagement with said exposed metal can negative terminal, the improvement in said switching means comprising a bend in said spring wire conductor forming a fulcrum approximately midway between said terminus and said free end of said spring wire conductor to engage said insulating body and limit the bending of said spring wire conductor essentially to the portion thereof between said fulcrum and said free end thereof when said spring wire conductor is pressed inwardly to engage said negative terminal of said first cell to light said flashlight.

* * * * *